United States Patent [19]

Coberley et al.

[11] 4,099,462

[45] Jul. 11, 1978

[54] ALTERNATING CURRENT ENERGIZED PRINTING SYSTEM UTILIZING A DIELECTRIC COVERED RESILIENT IMPRESSION ROLLER

[75] Inventors: Daniel A. Coberley; Joel F. Hutchison, both of Danville, Ill.

[73] Assignee: Hurletron Altair, Inc., Danville, Ill.

[21] Appl. No.: 513,498

[22] Filed: Oct. 9, 1974

Related U.S. Application Data

[60] Continuation of Ser. No. 373,367, Jun. 25, 1973, abandoned, and a continuation-in-part of Ser. No. 188,606, Oct. 12, 1971, abandoned, which is a division of Ser. No. 852,783, Aug. 25, 1969, abandoned.

[51] Int. Cl.[2] ..... B41F 9/06; G03G 13/14; G03G 15/14

[52] U.S. Cl. ..... 101/153; 101/170; 101/219

[58] Field of Search ..... 101/153, 170, 219

[56] References Cited

U.S. PATENT DOCUMENTS

| | | | |
|---|---|---|---|
| 2,520,504 | 8/1950 | Hooper | 101/426 |
| 3,316,879 | 5/1967 | Washburn | 101/639 |
| 3,477,369 | 11/1969 | Adamson et al. | 101/153 |
| 3,489,082 | 1/1970 | Morris | 101/153 |
| 3,508,491 | 4/1970 | Williamson et al. | 101/170 X |

FOREIGN PATENT DOCUMENTS

| | | | |
|---|---|---|---|
| 1,159,923 | 7/1969 | United Kingdom | 101/219 |

*Primary Examiner*—Clyde I. Coughenour
*Attorney, Agent, or Firm*—Hill, Gross, Simpson, Van Santen, Steadman, Chiara & Simpson

[57] ABSTRACT

A printing system where the alternating current energized semiconductive layer of the impression roller has a covering of dielectric material with a controlled thickness, and with a dielectric constant many times greater than that of the web, such that a major portion of the applied electric potential is transmitted to the web by means of a reactive current through the covering.

6 Claims, 3 Drawing Figures

ALTERNATING CURRENT ENERGIZED PRINTING SYSTEM UTILIZING A DIELECTRIC COVERED RESILIENT IMPRESSION ROLLER

CROSS REFERENCE TO RELATED APPLICATIONS

The present application is a continuation of our copending application Ser. No. 373,367 filed June 25, 1973 now abandoned, and a continuation in part of our application U.S. Ser. No. 188,606 filed Oct. 12, 1971, now abandoned, which in turn is a division of our application U.S. Ser. No. 852,783 filed Aug. 25, 1969, now abandoned.

Reference is also made to Hutchison U.S. Ser. No. 816,696 filed Apr. 16, 1969, now abandoned.

The Adamson et al U.S. Pat. No. 3,477,369 issued Nov. 11, 1969 shows further details of an electrically assisted gravure printing system to which the present invention may be applied.

SUMMARY OF THE INVENTION

This invention relates to a printing roller and particularly to such a roller for current assisted printing systems, or for use in conventional gravure systems.

An object of the invention is to provide an improved printing roller for electrically assisted printing systems.

A further object is to provide an improved gravure impression cylinder capable of utilizing an elastomer material of optimum thermal conductivity and resilience.

A significant contribution of the present invention resides in the provision of a printing roller capable of having a new covering applied thereto at the user's plant, and to a novel method and apparatus for effecting such result.

A feature of the present invention resides in the provision of a covering for an electrical printing roller comprising an extruded sleeve capable of being manufactured with great uniformity particularly with respect to its electrical properties.

A further feature of the invention resides in the provision of a sleeve capable of forming a protective covering for a conventional gravure impression roller, and thus enabling the use of an optimum substrate material without regard to its solvent resistance, for example.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

DETAILED DESCRIPTION OF THE PREFERRED EMBODIMENTS

Figure 1:
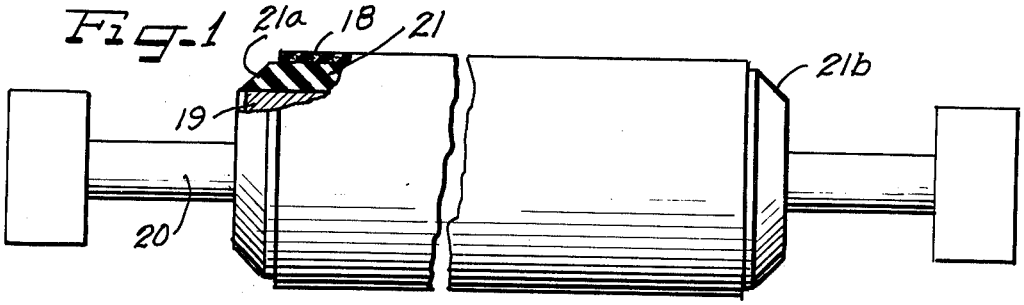
FIG. 1 is a somewhat diagrammatic side elevational view of an impression roller for an electrically assisted printing system, with a portion of the impression roller broken away to show the novel construction thereof.

The electrical printing roller, for example in an electrically assisted gravure printing system, is considered to be the most critical component because of the stringent and relatively narrow electrical requirements for such roller.

Conventional gravure impression rollers used in presses without the application of electric potential are limited in their advantageous characteristics because of the need for solvent resistance in the printing environment. Accordingly, optimum thermal conduction and resilience, for example, have not been achieved in the conventional gravure impression roller. It is conceived that the provision of a sleeve cover, for example formed of heat shrinkable material, will enable the use of a covering with excellent chemical and abrasion resistance, while the underlying substrate of the roller can have optimum thermal conduction and resilience. For example, the outer covering sleeve may be of neoprene, while the material of the substrate may be of natural rubber or other material with thermal conductivity and resilience substantially equivalent to that of natural rubber. This permits not only longer life, but higher press speeds. When excessive wear or catastrophic failure takes place, the covering sleeve is simply replaced. Such replacement can take place at the user's plant, thus avoiding the delay due to shipping and the like which is generally the case at present.

In an electric printing roller, in addition to conventional parameters, one needs an electrical parameter critically related to the printing system. Such printing systems include those utilizing direct current potential and alternating current potential, for example, as will hereinafter be explained.

By way of example, in an electrically assisted gravure printing system, printing conditions are encountered whereby portions of the impression roller contact the design cylinder to print a partial web. Using an applied direct current potential, for example, such contact interferes with the electrical function and the amount of assist becomes a compromise. With the use of the extruded sleeve configuration contemplated herein, it is entirely practical to use a partial sleeve covering of the impression roller, thus permitting an adjustment of the width of the conducting surface to correspond to that of the web without any change of the basic impression roller.

In the case of electrically assisted printing, when an electrical property is required of the sleeve, the present invention provides an optimized geometry enabling precise control of the parameter in manufacture and in auditing. Conventional rollers must be refaced frequently to extend the life of the rollers with a consequent progressive reduction in diameter. This change adversely affects the electrical properties. When the covering sleeve configuration of the present disclosure is replaced, satisfactory control for the electrical parameters is maintained simply by the proper selection of the thickness of the replacement covering sleeve. Although the sleeve cover may be refaced, one has a satisfactory control for the electrical parameters by maintaining a defined thickness.

Replacement of the sleeve for any roller may be done locally and in a few hours. Where rollers must be returned to the vendor and revulcanized as with prior art impression rollers a time loss of several weeks commonly results. Rollers are heavy and consequently shipping costs are high.

A preferred apparatus for applying a heat-shrinkable sleeve to a roll is shown in MacCallum, Howard and Coberley U.S. Pat. No. 3,677,856 issued July 18, 1972, and assigned to the present assignee, and may comprise an impression roller support which is rotatable on a vertical axis and which is so shaped as to receive the lower journal of the roller and to support the roller during insertion into a sleeve. A means to rotate the roller at a variable speed is provided fixed to the rate of rise of a circumferential heater. The heater is so constructed as to permit convextion to preheat the sleeve and to provide a maximum average radiant watt density of 80 watts per square inch (variable). A belt is wrapped for at least 360° about the lower part of the sleeve and is tensioned to exert uniform pressure about the entire perimeter of the sleeve. Energy is then applied, for example heat energy by means of the aforesaid heater, tending to cause the sleeve to constrict onto the roller. The rotation of the roller serves to drive the belt and also to cause the belt to move progressively along the axis of the roller to smoothly apply the sleeve to the roller and to progressively remove entrapped gases. In one embodiment, a reservoir of adhesive is formed between the roller and sleeve at the lower portion thereof, the belt serving to progressively move the reservoir upwardly to distribute the adhesive over the interface between the roller and the sleeve.

Figure 2:
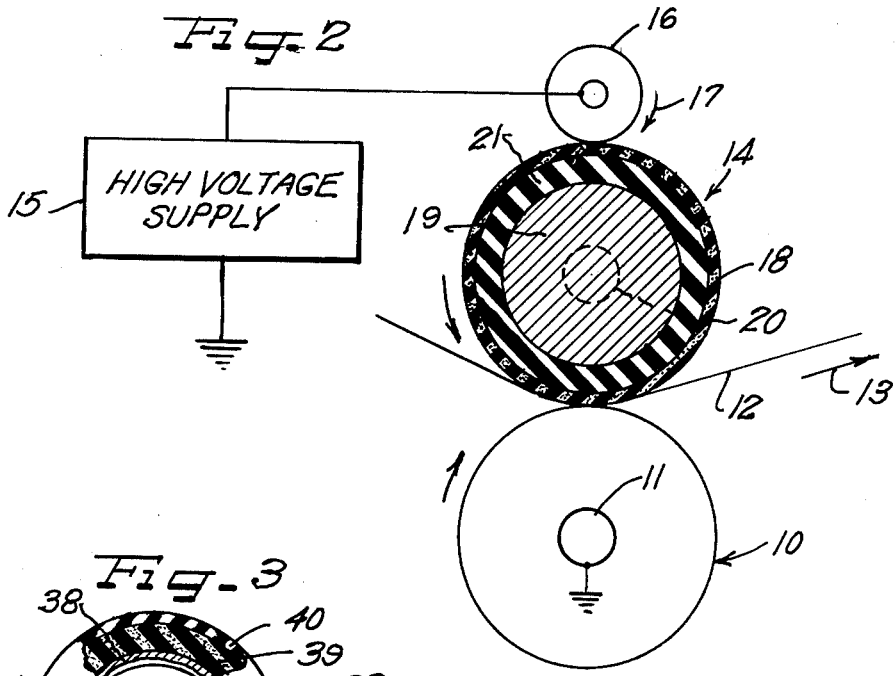
FIG. 2 is a somewhat diagrammatic end elevational view of an electrically assisted printing system utilizing the impression roller of FIG. 1 and showing the impression roller in cross section.

Referring specifically to the embodiment of FIGS. 1 and 2, an electrically assisted printing system is shown including a design cylinder 10 rotatable about a horizontal axis and supported by means of a grounded metal shaft 11 so that the surface of the design cylinder contacting the under surface of web 12 is essentially at ground potential. In the system as illustrated in FIG. 2 it is contemplated that the web 12 moves in the direction of arrow 13 through a nip region between design cylinder 10 and an impression roller 14 in accordance with the present invention. In the system illustrated, a high voltage supply 15 supplies a direct current potential through an idler roller 16 rotating in the direction of arrow 17 and of conductive material so as to transmit the applied potential to an electrically conductive covering 18 of the impression roller 14. The impression roller is provided with a metal core 19 mounted for rotation on a shaft 20, which may be grounded in the illustrated embodiment, a resilient insulating layer 21 being interposed between the metal core 19 and the conductive outer covering or sleeve 18. As seen in FIG. 1, the insulating layer 21 tapers at its opposite axial ends, as indicated at 21*a* and 21*b*.

In this construction, the conductive sleeve 18 should have a thickness of not greater than about ⅛ inch. It is considered that the operable range where the sleeve 18 is applied by a heat shrinking technique extends from a maximum thickness of about 0.140 inches down to a minimum thickness 0.020 inch. The resistivity of the material is in the range from about $10^4$ ohm-centimeters to $10^8$ ohm-centimeters. Such resistivity may be measured in accordance with A.S.T.M. standards. Durometer is an important parameter for impression rollers. One finds that with a sleeve covering thickness of ⅛ inch or less, a sleeve material durometer of 80–85 Shore A, a substrate thickness of ½ inch or more and a substrate durometer of 65–95 Shore A, the composite roller as indicated at 14 in FIG. 2 will have a durometer of 65–95 Shore A, that is a durometer corresponding to that of the substrate.

In the illustrated embodiment, it is contemplated that the resilient layer 21 is bonded to the core 19 or vulcanized by conventional methods. The outer covering sleeve 18 is preferably adhesively bonded to the layer 21 by the method and apparatus referred to herein. An example of a suitable conductive elastomer material for the outer conductive sleeve 18 is a heat shrinkable irradiated neoprene. An example of material for the substrate resilient layer 21 would be natural rubber or a synthetic material having substantially equivalent characteristics, particularly equivalent thermal conductivity and resilience.

An impression roller such as shown at 14 in FIGS. 1 and 2 and having the characteristics herein described is of substantial value in a conventional gravure printing system where no electric potential is applied thereto. Thus, the covering sleeve 18 may be of a material having optimum solvent resistance so as to be relatively immune to the printing environment, while the substrate layer 21 can be selected for optimum properties other than solvent resistance such as optimum thermal conductivity and resilience. As an example, natural rubber would not have the required solvent resistance to provide optimum life, but would have substantially better thermal conductivity and resilience than the neoprene material of the sleeve 18.

In each of the embodiments, the sleeve 18 is preferably formed by extruding so as to be of homogeneous continuous annular cross section and preferably with a thickness of not more than about ⅛ inch.

Figure 3:
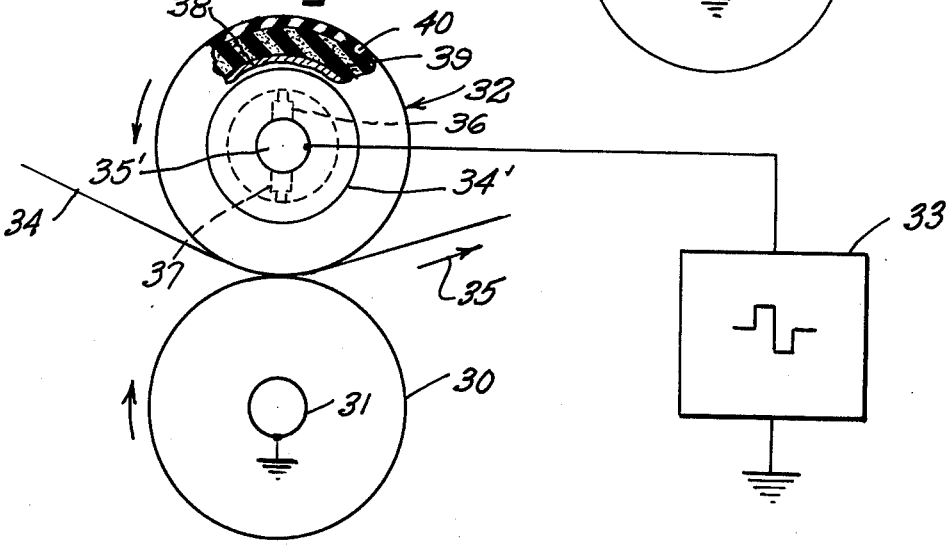
FIG. 3 is somewhat diagrammatic end elevational view of a further form of electrically assisted printing system utilizing an impression roller in accordance with the present invention.

Referring to FIG. 3, there is illustrated an alternating current printing system including a design cylinder 30 having a grounded shaft 31 and cooperating with an impression roller 32 which receives an alternating current potential from an alternating potential source 33. A web 34 as indicated as moving in the direction of arrow 35 through a printing zone or nip region between the design cylinder 30 and impression roller 32. In this embodiment an insulated bearing 34' journals a metal shaft 35' which serves to supply the alternating current potential to brush means such as indicated at 36 and 37 in sliding contact with the metal core 38 of the roller. The roller 32 further includes a resilient substrate layer 39 and an outer covering sleeve 40 of dielectric material. By way of example, the dielectric material of sleeve 40 may have a dielectric constant between 20 and 40. By way of example where the sleeve 40 is of a heat shrinkable elastomer dielectric material, the thickness thereof is not more than about ⅛ inch. Preferably the sleeve 40 is bonded to the substrate 39 by means of an adhesive as previously described, the substrate 39 being bonded or vulcanized to the core 38. As an example, the sleeve 40 may be made of a heat shrinkable irradiated elastomer material such as neoprene. Neoprene has the advantage of being ozone resistant, to a substantially greater degree than natural rubber, for example.

As another example, the sleeve 40 may comprise a sleeve of homogeneous continuous annular cross section and of dielectric elastomer material having a thickness between about 1/16 inch and about ⅛ inch, and a dielectric constant between about 20 and about 100, for example substantially 40. The sleeve may be of vulcanized rubber or the like rather than being formed of heat shrinkable material. Further the sleeve preferably has a resistivity substantially greater than the resistivity of the conductive layer 39 and preferably in the range from about $10^8$ ohm - centimeters to about $10^{12}$ ohm - centimeters, or greater.

We claim as our invention:

1. In a system for assisting the transfer of ink, carried on a metal printing cylinder connected to ground potential, to a web of substantially non-conductive material as the web passes along a web path through a nip between the grounded printing cylinder and the outer perimeter of a resiliently covered metal impression cylinder, including the combination of:

an electrically conductive inner layer of resilient material on said impression cylinder, means mounting said impression cylinder for rotation on its central axis and insulating said electrically conductive layer of resilient material on said impression cylinder from ground potential, an outer sleeve of dielectric material of homogeneous continuous annular cross section having a width substantially equal to the width of the outer perimeter of the impression cylinder, and having a resistivity substantially greater than that of said conductive layer, and means comprising an electric circuit connected with said electrically conductive layer for applying an electric potential between said electrically conductive layer and said grounded printing cylinder, the entire operative width of the outer perimeter of the impresion cylinder being formed entirely by said dielectric material of said outer sleeve, said dielectric material having a thickness less than ⅛ of an inch and having a dielectric constant between 20 and 100, and said electric circuit comprising an alternating potential source for applying an alternating current electric potential between said electrically conductive inner layer of resilient material and said grounded printing cylinder to produce an alternating reactive current from said electrically conductive inner layer through said dielectric material of said outer sleeve over the entire operative width of said impression cylinder.

2. A system according to claim 1, with said impression cylinder having an electrically conductive metal core electrically insulated from ground potential and in electrical contact with the inner periphery of said electrically conductive inner layer of resilient material, and said alternating potential source being electrically connected with said electrically conductive metal core for supplying alternating current electrical potential to the interior side of said electrically conductive inner layer and thereby to produce an alternating reactive current through said electrically conductive inner layer and through said dielectric material of said outer sleeve over the entire operative width of said impression cylinder.

3. A system according to claim 1, with said mounting means for said impression cylinder comprising an electrically conductive shaft mounting said impression cylinder and electrically insulated from ground potential, said alternating potential source being electrically connected with said electrically conductive shaft for supplying alternating current electrical potential to the interior side of said electrically conductive inner layer and thereby to produce an alternating reactive current from said electrically conductive inner layer through said dielectric material of said outer sleeve over the entire operative width of said impression cylinder.

4. In a system for assisting the transfer of ink, carried on a metal printing cylinder connected to ground potential, to a web of substantially non-conductive material as the web passes along a web path through a nip between the grounded printing cylinder and the outer perimeter of a resiliently covered metal impression cylinder, including the combination of:

an electrically conductive layer of resilient material of annular cross section on said impression cylinder, means insulating said electrically conductive layer of resilient material on said impression cylinder from ground potential, an outer sleeve of dielectric material of homogeneous continuous annular cross section forming the outer perimeter of the impression cylinder and disposed directly at said web path for direct contact with the web at said nip over the operative width of said outer perimeter of said impression cylinder, and having a resistivity substantially greater than that of said conductive layer, and means comprising an electric circuit connected with said electrically conductive layer for applying an electric potential between said electrically conductive layer and said grounded printing cylinder, the entire operative width of the outer perimeter of the impression cylinder which is to contact the web being formed entirely by said dielectric material of said outer sleeve, said dielectric material having a thickness less than one-eighth of an inch and having a dielectric constant between twenty and one hundred, and said electric circuit comprising an alternative potential source for applying an alternating current electric potential between said electrically conductive layer of resilient material and said grounded printing cylinder to produce an alternating reactive current from said electrically conductive layer through said dielectric material of said outer sleeve over the entire operative width of said impression cylinder.

5. A system according to claim 4 with said alternating potential source having a metallic conductive path connecting it with the inner periphery of said electrically conductive material of annular cross section for supplying alternating current electrical potential to the interior side of said electrically conductive layer and thereby to produce an alternating reactive current through said electrically conductive layer and through said dielectric material of said outer sleeve over the entire operative width of said impression cylinder.

6. The system of claim 4 with said outer sleeve of dielectric material having a thickness between about 1/16 inch and about ⅛ inch and a resistivity in the range from about $10^8$ ohm-centimeters to about $10^{12}$ ohm-centimeters.

* * * * *